US010022637B2

(12) United States Patent
Cai

(10) Patent No.: US 10,022,637 B2
(45) Date of Patent: Jul. 17, 2018

(54) HAND-HELD YO-YO BALL CAPABLE OF MANUALLY STORING ENERGY

(71) Applicants: Guangdong Alpha Animation & Culture Co., Ltd., Shantou (CN); Guangdong Auldey Animation & Toy Co., Ltd., Guangzhou (CN); Guangzhou Alpha Culture Communications Co., Ltd., Guangzhou (CN)

(72) Inventor: Dongqing Cai, Shantou (CN)

(73) Assignees: Guangdong Alpha Animation and Culture Co., Ltd. (CN); Guangdong Auldey Animation & Toy Co., Ltd. (CN); Guangzhou Alpha Culture Communications Co., Ltd. (CN)

( * ) Notice: Subject to any disclaimer, the term of this patent is extended or adjusted under 35 U.S.C. 154(b) by 62 days.

(21) Appl. No.: 14/903,207

(22) PCT Filed: Jan. 17, 2015

(86) PCT No.: PCT/CN2015/070950

§ 371 (c)(1),
(2) Date: Jan. 6, 2016

(87) PCT Pub. No.: WO2016/061917

PCT Pub. Date: Apr. 28, 2016

(65) Prior Publication Data

US 2016/0325191 A1 Nov. 10, 2016

(30) Foreign Application Priority Data

Oct. 25, 2014 (CN) ..... 2014 1 0575168

(51) Int. Cl.
*A63H 1/30* (2006.01)
*A63H 29/02* (2006.01)

(52) U.S. Cl.
CPC ..... *A63H 1/30* (2013.01); *A63H 29/02* (2013.01)

(58) Field of Classification Search
CPC ..... A63H 1/30; A63H 29/02; A63H 29/04
(Continued)

(56) References Cited

U.S. PATENT DOCUMENTS 3,724,121 A * 4/1973 Atkins ..... A63H 1/30 446/250
4,327,518 A * 5/1982 Knauff ..... A63H 1/24 446/242

(Continued)

FOREIGN PATENT DOCUMENTS

CN 2427254 Y 4/2001
CN 2902385 Y 5/2007

(Continued)

OTHER PUBLICATIONS

International Search Report for Application No. PCT/CN2015/070950 dated Jul. 30, 2015.

(Continued)

*Primary Examiner* — Melba Bumgarner
*Assistant Examiner* — Joseph B Baldori
(74) *Attorney, Agent, or Firm* — Lerner, David, Littenberg, Krumholz & Mentlik, LLP

(57) ABSTRACT

The present invention discloses a hand-held yo-yo ball capable of manually storing energy, comprising two rotating bodies and a connecting shaft, where each rotating body comprises a disk body and a shell; one disk body is internally provided with a clutch mechanism, the other disk body is internally provided with an energy storage mechanism; two ends of the connecting shaft are respectively connected with the clutch mechanism and the energy storage mechanism; the rotating body at the end where the clutch mecha- (Continued)

nism is located is manually rotated, energy is stored in the energy storage mechanism, then the meshing state of the clutch mechanism is manually removed, so that the energy storage mechanism releases the energy to drive the two rotating bodies to rotate synchronously. In this way, the yo-yo ball can be rotated without throwing a ball body of the yo-yo ball by a rope.

10 Claims, 7 Drawing Sheets

(58) Field of Classification Search
USPC ..... 446/248, 249, 250, 260, 464
See application file for complete search history.

(56) References Cited

U.S. PATENT DOCUMENTS 4,332,102 A * 6/1982 Caffrey ..... A63H 1/30 446/250
4,601,474 A * 7/1986 Lew ..... A63B 67/10 446/249
4,683,986 A * 8/1987 Darda ..... A63H 29/06 185/39
5,184,972 A * 2/1993 Tomberlin ..... A63H 1/30 446/249
5,947,793 A * 9/1999 Yamakawa ..... A63H 33/005 446/431
6,123,596 A 9/2000 Hsu
6,196,894 B1 * 3/2001 Kennedy ..... A63H 29/04 185/40 H
6,579,142 B1 * 6/2003 Rehkemper ..... A63H 1/30 446/247
7,059,932 B1 * 6/2006 Tobias ..... A63H 1/04 446/250
7,125,310 B1 * 10/2006 Van Dan Elzen ..... A63H 1/30 446/247
7,950,976 B2 * 5/2011 Bernstein ..... A63H 17/008 446/39
8,187,052 B2 * 5/2012 Van Dan Elzen ..... A63H 1/30 446/247
9,440,157 B1 * 9/2016 Cai ..... A63H 29/22
2004/0198151 A1 * 10/2004 Bell ..... A63H 1/30 446/247
2007/0026762 A1 2/2007 McPhee
2010/0317254 A1 * 12/2010 Van Dan Elzen ..... A63H 1/30 446/250
2011/0070983 A1 3/2011 Yukihiro
2016/0325192 A1 * 11/2016 Cai ..... A63H 29/02

FOREIGN PATENT DOCUMENTS

CN 201921470 U 8/2011
CN 203447754 U 2/2014
CN 104274975 A 1/2015
CN 204121741 U 1/2015
DE 29815344 U1 11/1998
KR 20070103599 A 10/2007

OTHER PUBLICATIONS

Supplementary European Search Report for EP Application No. 15819778.0 dated Mar. 7, 2017.

* cited by examiner

HAND-HELD YO-YO BALL CAPABLE OF MANUALLY STORING ENERGY

CROSS REFERENCE TO RELATED APPLICATIONS

The present application is a national phase entry under 35 U.S.C. § 371 of International Application No. PCT/CN2015/070950, filed Jan. 17, 2015, which claims priority from Chinese Patent Application No. 201410575168.5 filed Oct. 25, 2014, all of which are hereby incorporated herein by reference.

TECHNICAL FIELD

The present invention relates to a yo-yo ball, and particularly to a hand-held yo-yo ball capable of manually storing energy.

BACKGROUND

In the current market, a yo-yo ball consists essentially of two rotating bodies and a connecting shaft connecting the two rotating bodies. A rope entwines in the middle of the two rotating bodies. The yo-yo ball body is thrown down at full tilt so that the yo-yo ball body can rotate quickly at the end of the rope. However, limited by a recovery system and a bearing system of the yo-yo ball, a shorter user is unable to play by throwing down the yo-yo ball body using the rope. This is because the length of the rope is in direct proportion to the height of the user. For a taller user, after the ball body is thrown down, there is enough acceleration region for the ball body to accelerate to a certain speed, to complete various fancy moves. However, for a shorter player, the player is unable to complete a move because the acceleration region is too short after the ball body is thrown down and the rotational speed of the ball body is not fast enough.

SUMMARY OF THE EMBODIMENTS

An objective of the present invention is to solve the above problems, and to provide a hand-held yo-yo ball capable of manually storing energy which is interesting and which can be rotated to store energy.

The technical solution of the present invention is implemented as below:

A hand-held yo-yo ball capable of manually storing energy includes two rotating bodies and a connecting shaft connecting the two rotating bodies. Either of the rotating bodies comprises a disk body and a shell. The disk body of one rotating body is internally provided with a clutch mechanism. The disk body of the other rotating body is internally provided with an energy storage mechanism. Two ends of the connecting shaft are respectively connected to the clutch mechanism and the energy storage mechanism. The rotating body at the end where the clutch mechanism is located is manually rotated, so that energy is stored in the energy storage mechanism. Thereafter, the meshing state of the clutch mechanism is manually removed, so that the energy storage mechanism releases the energy to drive the two rotating bodies to synchronously rotate.

The clutch mechanism includes a clutch gear set consisting of a first clutch gear and a second clutch gear, and an escapement member controlling the clutch gear set to engage or disengage. A control end of the escapement member extends from a middle of the shell of the rotating bodies. The shell is fixedly connected with the first clutch gear of the clutch gear set. The energy storage mechanism matches up with the second clutch gear of the clutch gear set by means of the connecting shaft. The escapement member is controlled so that after the clutch gear set is engaged, elastic potential energy is stored in the energy storage mechanism by manually rotating the shell. Thereafter, the escapement member is controlled so that the clutch gear set is disengaged. This causes the energy storage mechanism to release the elastic potential energy to drive the two rotating bodies to synchronously rotate.

The escapement member of the present invention includes a pressing cap extending from the middle of the shell, an escapement shaft having a convex ramp surface, a top pressure column sleeved at the lower part of the escapement shaft, a stroke seat for limiting a stroke of the top pressure column, and a spring mounted under the second clutch gear of the clutch gear set. The second clutch gear is used for jacking up the second clutch gear. In this regard, a round hole in the middle of the first clutch gear of the clutch gear set is correspondingly provided with a slope surface matching up with the convex ramp surface of the escapement shaft. A groove used for implementing engagement and disengagement of the clutch gear set and a block surface. By pressing the pressing cap, the convex ramp surface of the escapement shaft is switched into the groove of the first clutch gear to achieve that under the action of the spring, the second clutch gear jacks up to be engaged with the first clutch gear. By pressing the pressing cap once again, the convex ramp surface of the escapement shaft is switched into the block surface of the first clutch gear, to achieve that the top pressure column jacks down the second clutch gear until the second clutch gear is disengaged with the first clutch gear.

In order to implement that the first clutch gear drives the energy storage mechanism to rotate to store elastic potential energy, the lower part of the stroke seat is provided with an irregular hole, and the end corresponding to the connecting shaft is correspondingly designed to an irregular jack column which is matched up and connected with the irregular hole. After the irregular hole is matched up with the irregular jack column, it is locked and fixed by means of a screw. An upper surface of the stroke seat is convexly provided with an insertion lug. The first clutch gear is correspondingly provided with an insertion hole. By matching up the insertion lug with the insertion hole, when the shell is manually rotated, the first clutch gear drives the stroke seat and the connecting shaft to synchronously rotate, and further drives, by means of the rotation of the connecting shaft, the energy storage mechanism to store elastic potential energy.

In order to ensure that the second clutch gear can move vertically upward, and when the second clutch gear is rotating, that the rotating bodies can synchronously rotate, the disk body is upward convexly provided with three lugs. Correspondingly there is provided with three springs sleeved in the lugs. The second clutch gear is correspondingly provided with three lug holes sleeved on the lugs.

The energy storage mechanism of the present invention includes an energy storage spring, a spring case in which the energy storage spring is mounted, and a one-way gear mounted above the spring case and used for preventing the energy storage spring from reversely rotating to release energy when elastic potential energy is stored. Both the energy storage spring and the one-way gear can synchronously rotate with the connecting shaft. When the rotating body at the end where the clutch mechanism is located is manually rotated, the energy storage spring and the one-way gear synchronously rotate to store elastic potential energy.

Then the meshing state of the clutch mechanism is manually removed, so that the energy storage spring releases the elastic potential energy, and the one-way gear reversely rotates to drive the two rotating bodies to rotate synchronously.

Further, a through hole is formed in the middle of the spring case. The one-way gear is downward convexly provided with a lug that passes through the through hole and enters into the spring case. Along a periphery of the lug there is provided with a plurality of arc-shaped pieces distributed at interval, with a gap kept between the arc-shaped piece and the lug. At the lower end of the arc-shaped piece is provided with a hook. After the one-way gear is inserted into the through hole of the spring case, the hook stretches out of the through hole of the spring case to fasten to a side the through hole. In this way the one-way gear is relatively rotatably connected to the spring case, and an inside end of the energy storage spring is fixedly connected to the gap between the arc-shaped piece and the lug of the one-way gear.

In order to implement that the one-way gear can only unidirectionally rotate, the one-way gear includes an internal gear disk and a plurality of automatically rotatable limiting blocks positioned in the internal gear disk. A gear tooth of the internal gear disk is a helical gear tooth, and a limiting claw of the limiting block is clamped in the helical gear tooth, thereby realizing a unidirectional rotation of the one-way gear.

In order to implement that the shell at both sides the yo-yo ball can rotate to store elastic potential energy in the energy storage mechanism, on the shell of the rotating body at the end where the energy storage mechanism, there is provided a mounting position in which the limiting block is mounted. The middle of the shell is connected to the ends of the connecting shaft and locked and fixed by means of screws. In this way, when the shell is driven by the clutch mechanism to rotate in a meshing state, the energy storage spring and the one-way gear synchronously rotate to store elastic potential energy.

In order to ensure that two rotating bodies of the yo-yo ball body are consistent in weight to keep the balance of the center of gravity, the rotating body where the clutch mechanism is located is internally provided with a weight ring. The weight ring is placed in the disk body of the rotating body. A ring cover is covered on the weight ring and is locked to the disk body to fix the weight ring.

In the present invention, the disk body of one rotating body is internally provided with a clutch mechanism. The disk body of the other rotating body is internally provided with an energy storage mechanism. Two ends of the connecting shaft are respectively connected with the clutch mechanism and the energy storage mechanism. When the clutch mechanism is in a meshing state, by manually rotating the rotating body at the end where the clutch mechanism is located, both the connecting shaft and the energy storage mechanism at the other end can be driven to rotate. In this way, elastic potential energy is stored in the energy storage mechanism. After certain potential energy is stored, the meshing state of the clutch mechanism is manually removed, so that the energy storage mechanism releases the elastic potential energy to drive the two rotating bodies to synchronously rotate, i.e., the whole yo-yo ball body rotates. Therefore, it is not needed to use a rope to throw the yo-yo ball body down to make it rotate. In other words, the ball body can rotate at high speed even though the rope is too short, which is not affected by an acceleration region after the ball body is thrown down. Therefore, a user who is shorter may enjoy playing with the yo-yo ball to the fullest, and complete various fancy moves. Requirements of users at different ages and different heights can be met. Compared with an existing yo-yo ball, the hand-held yo-yo ball capable of manually storing energy increases a new operation mode and a new playing method, is more interesting, and more diversified in playing methods. In addition, an escapement member is used as an operating element for controlling the clutch gear set to engage and disengage. The escapement member is analogous to a push elastic structure of a ballpoint pen. By pressing the escapement member, the clutch gear set is engaged. By pressing the escapement member once again, the clutch gear set is disengaged, and so on. Therefore, the operation is convenient and efficient. The yo-yo ball is durable and not easy to be damaged, and the service life of the whole yo-yo ball is effectively improved. The yo-yo ball is slickly designed, not only meeting the requirements of shorter users for entertainment, but also increasing methods for playing with the yo-yo ball, being very interesting, meeting children's entertainment needs and psychology of seeking for what is novel, leaving room for players to give full scope to creativity in playing methods, and making the yo-yo ball be attractive to them for longer time.

The following further describes the present invention with reference to the accompanying drawings.

DETAILED DESCRIPTION OF EMBODIMENTS

Figure 1:
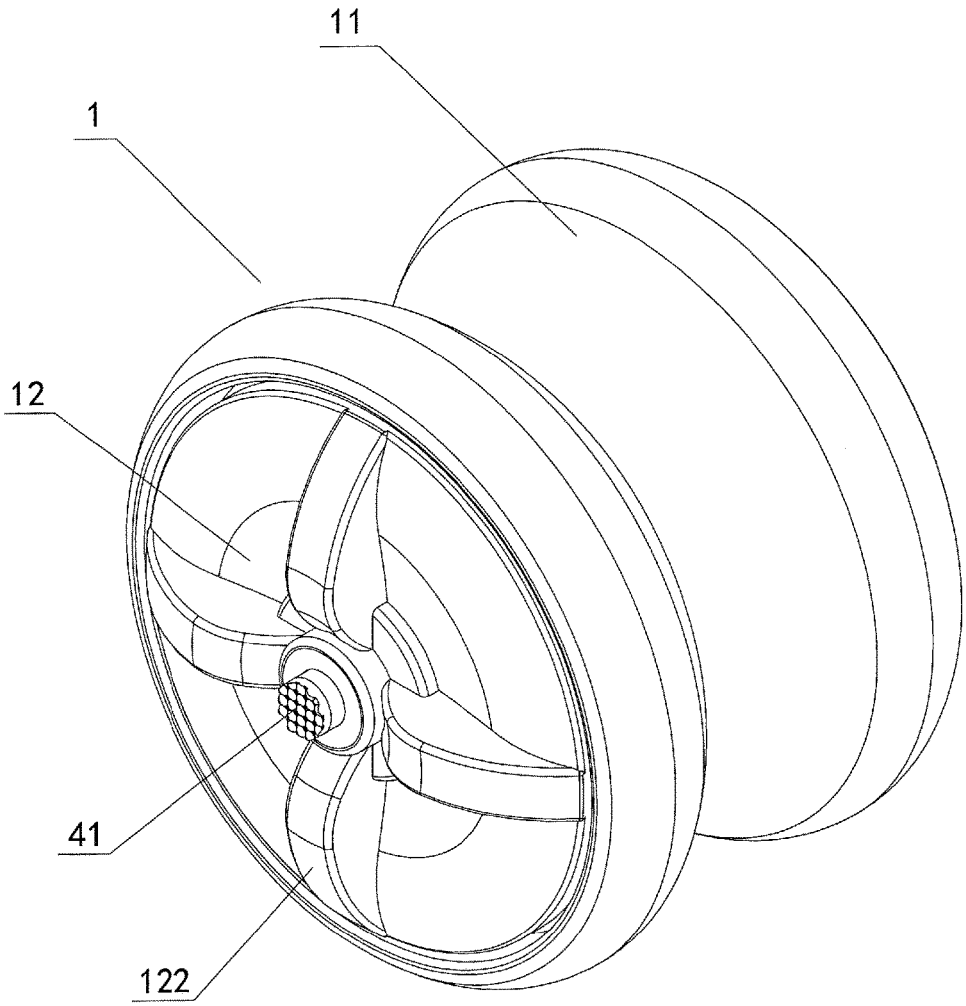
FIG. 1 is a tridimensional schematic structural diagram of the present invention.

As shown in FIGS. 1-6, a hand-held yo-yo ball capable of manually storing energy, includes two rotating bodies 1 and a connecting shaft 2 connecting the two rotating bodies 1. Either of the rotating bodies 1 may include a disk body 11 and a shell 12. The disk body 11 of one rotating body 1 is internally provided with a clutch mechanism. The disk body 11 of the other rotating body 1 is internally provided with an energy storage mechanism. The two ends of the connecting shaft 2 are respectively connected to the clutch mechanism and the energy storage mechanism. The rotating body 1 at the end where the clutch mechanism is located is manually rotated for storing energy in the energy storage mechanism. Thereafter, the meshing state of the clutch mechanism is manually removed, so that the energy storage mechanism releases the energy to drive the two rotating bodies 1 to synchronously rotate, i.e., the whole yo-yo ball body rotates. Therefore, it is not required to use a rope to throw the yo-yo ball body down to make it rotate. In other words, the ball body can rotate at high speed even though the rope is too short, which is not affected by an acceleration region after the ball body is thrown down. Therefore, even a shorter player may enjoy playing with the yo-yo ball to the fullest, and complete various fancy moves. Requirements of players at different ages and different heights can be met. Compared with an existing yo-yo ball, the hand-held yo-yo ball is capable of manually storing energy providing a new operation mode and a new playing method, which is more interesting, and more diversified in playing methods.

Figure 2:
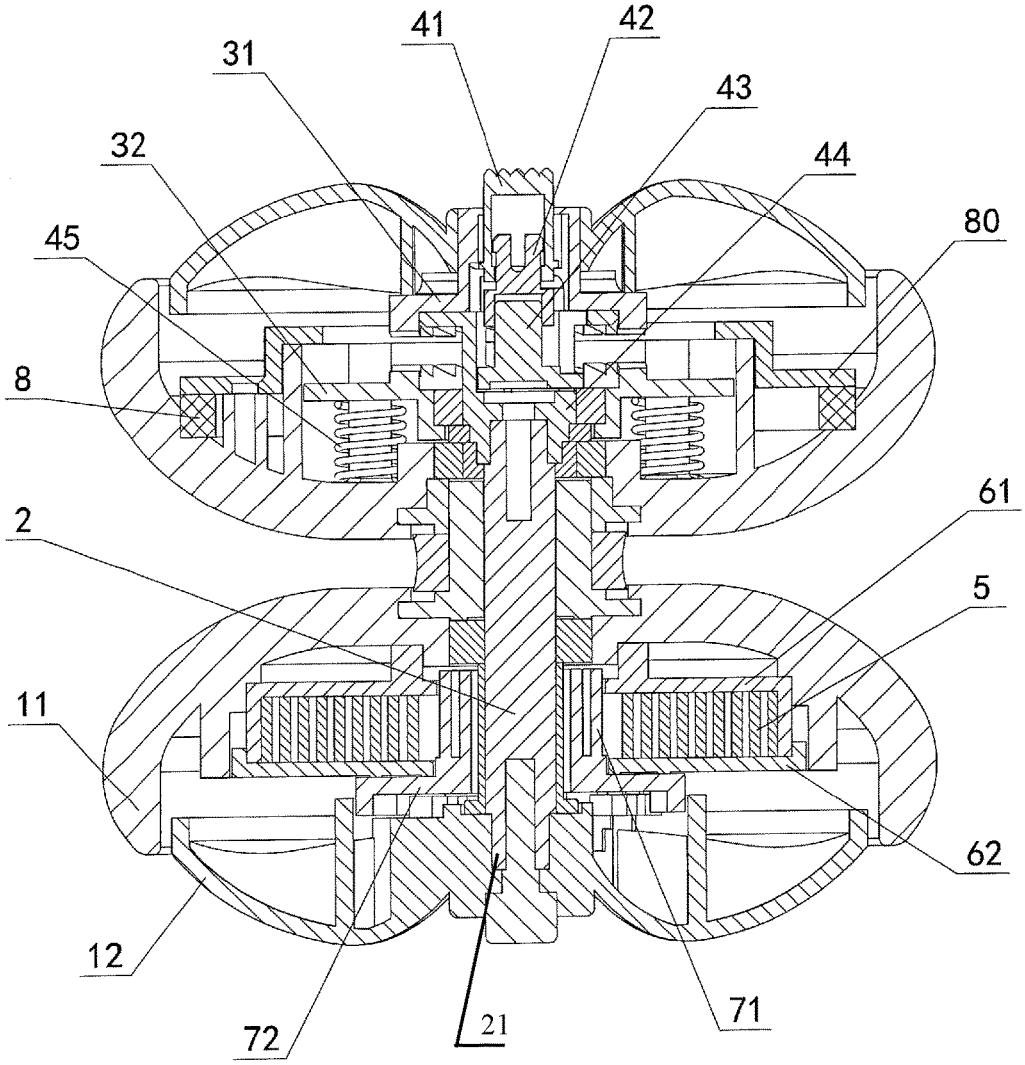
FIG. 2 is a schematic structural sectional view of the present invention.
Figure 3:
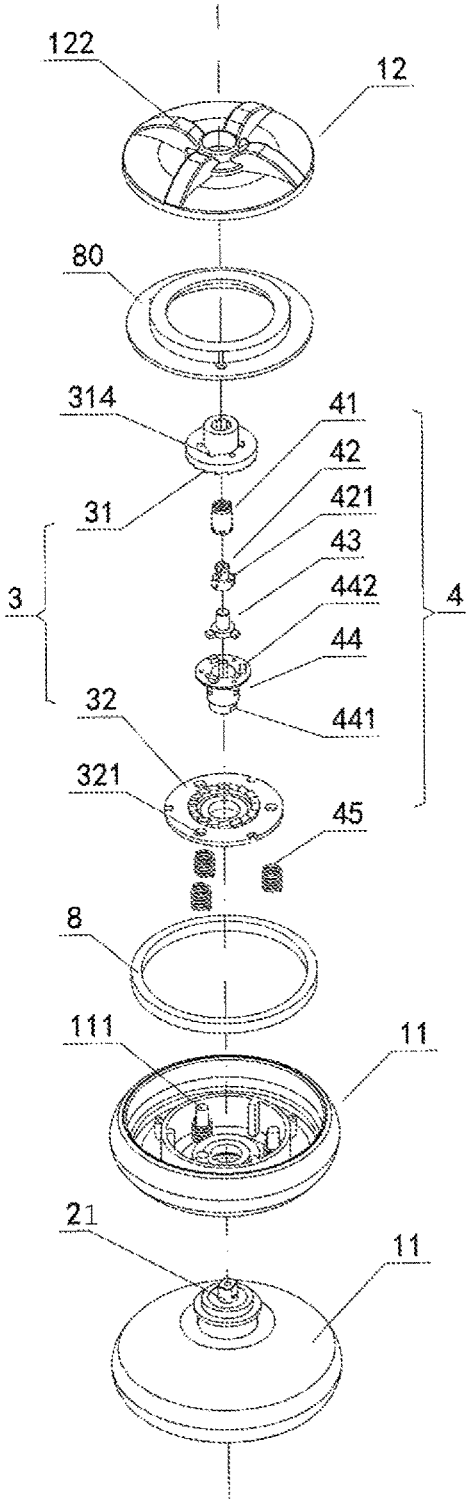
FIG. 3 is a schematic structural diagram of disassembly and assembly of the rotating body at the end where the clutch mechanism is located according to the present invention.
Figure 4:
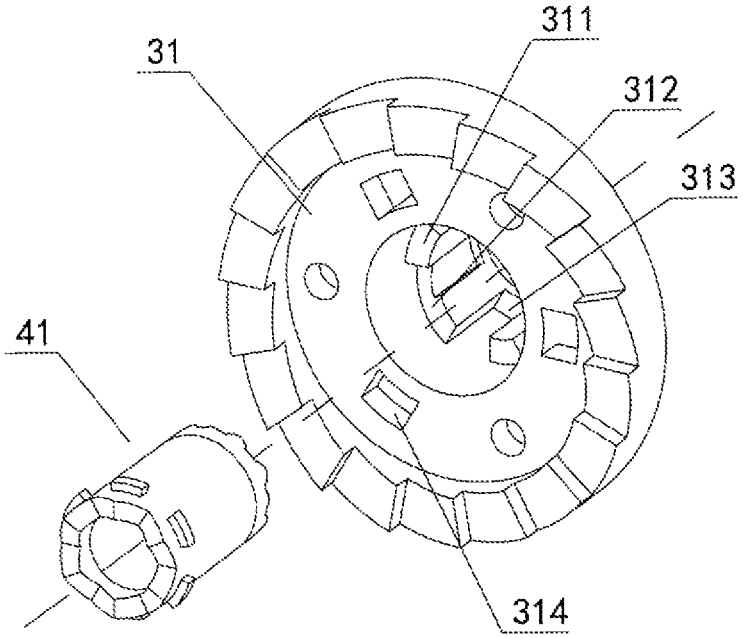
FIG. 4 is a schematic structural diagram of assembly of the escapement shaft and the first clutch gear of the present invention.

As shown in FIG. 3, the clutch mechanism of this embodiment includes a clutch gear set 3 consisting of a first clutch gear 31 and a second clutch gear 32, and an escapement member 4 which controls the clutch gear set 3 to engage or disengage. The first clutch gear 31 is a "I" shaped crown gear, where gear teeth are disposed along a periphery of the lower surface. A round hole is formed in the middle of the first clutch gear 31. The round hole is provided with a slope surface 311, a groove 312 and a block surface 313. As shown in FIG. 2, an upper cylinder of the first clutch gear 31 is inserted and connected in the through hole in the middle of the shell 12 of the rotating body 1. The second clutch gear 32 of this embodiment is a gear having a round face. Gear teeth are convexly disposed on the upper surface of the round face. A stepped bore is formed in the middle of the round face. Near the periphery of the round face there is provided three cylindrical holes 321. On the edge of the round face there is provided three notches. Convex edges sunk in the notches are disposed in the position of the disk body 11 of the rotating body 1, corresponding to the three notches. The escapement member 4 of this embodiment includes a pressing cap 41, an escapement shaft 42, a top pressure column 43, a stroke seat 44 and a spring 45. At the lower edge of the pressing cap 41 there is provided a limit block. The round hole of the first clutch gear 31 is correspondingly provided with a limit slot. The pressing cap 41 first passes, from the lower part of the first clutch gear 31, through the round hole, and then extends from the through hole in the middle of the shell 12, out of the shell 12. Both the limit slot and the limit block can prevent the pressing cap 41 from falling from the shell 12. The lower edge of the pressing cap 41 is designed to be a sawtooth. The upper part of the escapement shaft 42 is an elastic lug which can be inserted and connected in the hole of the pressing cap 41 and is prevented from falling off. The escapement shaft 42 is provided with a convex ramp surface 421. By pressing the pressing cap 41, the convex ramp surface 421 of the escapement shaft 42 is switched into the groove 312 of the first clutch gear 31. By pressing the pressing cap 41 once again, the convex ramp surface 421 of the escapement shaft 42 is switched into the block surface 313 of the first clutch gear 31. The upper part of the top pressure column 43 is inserted and connected in the hole of the escapement shaft 42. The lower part of the top pressure column 43 is pressed into the stepped bore in the middle of the second clutch gear 32. At the lower edge of the top pressure column 43 there is convexly provided three stroke blocks. The stroke seat 44 is provided with three stroke grooves. The three stroke blocks on the top pressure column 43 are positioned in the stroke grooves to limit the moving distance of the top pressure column 43. The lower part of the stroke seat 44 is provided with an irregular hole 441. The end corresponding to the connecting shaft 2 is correspondingly designed to be an irregular jack column 21 which is matched up and connected with the irregular hole 441. After the irregular hole 441 is matched up with the irregular jack column 21, it is locked and fixed by means of screws. The upper surface of the stroke seat 44 is convexly provided with an insertion lug 442. The first clutch gear 31 is correspondingly provided with an insertion hole 314. By matching up the insertion lug 442 with the insertion hole 314, the stroke seat 44 may synchronously rotate with the first clutch gear 31. In this embodiment, a total of three springs 45 are disposed, the disk body 11 of the rotating body 1 is upward convexly provided with three lugs 111, the springs 45 are sleeved in the lugs 111, and the three lug holes 321 on the second clutch gear 32 are sleeved on the lugs 111. After the foregoing parts are connected and matched up, the first clutch gear 31 and the shell 12 are fixedly connected and can synchronously rotate. When the pressing cap 41 is pressed down, the escapement shaft 42 and the top pressure column 43 can be driven to move. The stroke seat 44 is stationary relatively to the rotating bodies 1 in position and rotates synchronously with the connecting shaft 2. Under the action of the springs 45, while the second clutch gear 32 always has a trend to jacking up. When the convex ramp surface 421 of the escapement shaft 42 is switched into the groove 312 of the first clutch gear 31, the top pressure column 43 is not subjected to downward pressure from the escapement shaft 42, and thus is unable to exert top pressure on the second clutch gear 32. Therefore, under the action of the springs 45, the second clutch gear 32 jacks up and is engaged with the first clutch gear 31. Simultaneously, the top pressure column 43, the escapement shaft 42 and the pressing cap 41 are lifted up under the action of the springs 45. When the convex ramp surface 421 of the escapement shaft 42 is switched into the block surface 313 of the first clutch gear 31, the escapement shaft 42 moves downward to a state of pressing down the top pressure column 43. As a result, the top pressure column 43 exerts top pressure on the second clutch gear 32 to make it move downward, thereby enabling the second clutch gear 32 to be disengaged from the first clutch gear 31.

Figure 5:
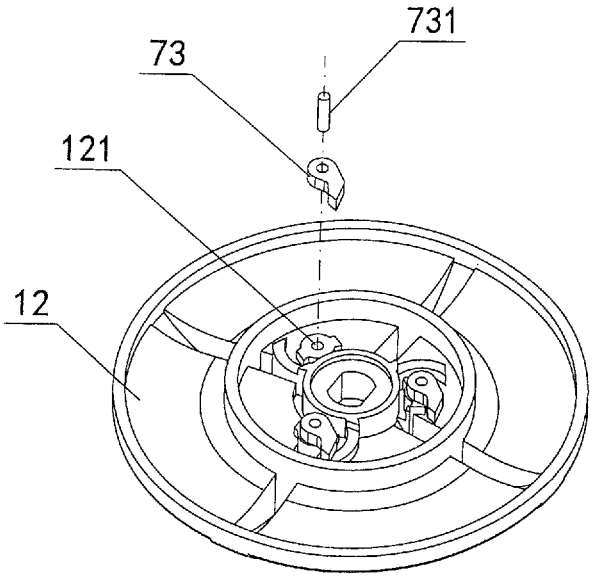
FIG. 5 is a schematic structural diagram of assembly of the limiting block and the shell of the present invention.
Figure 6:
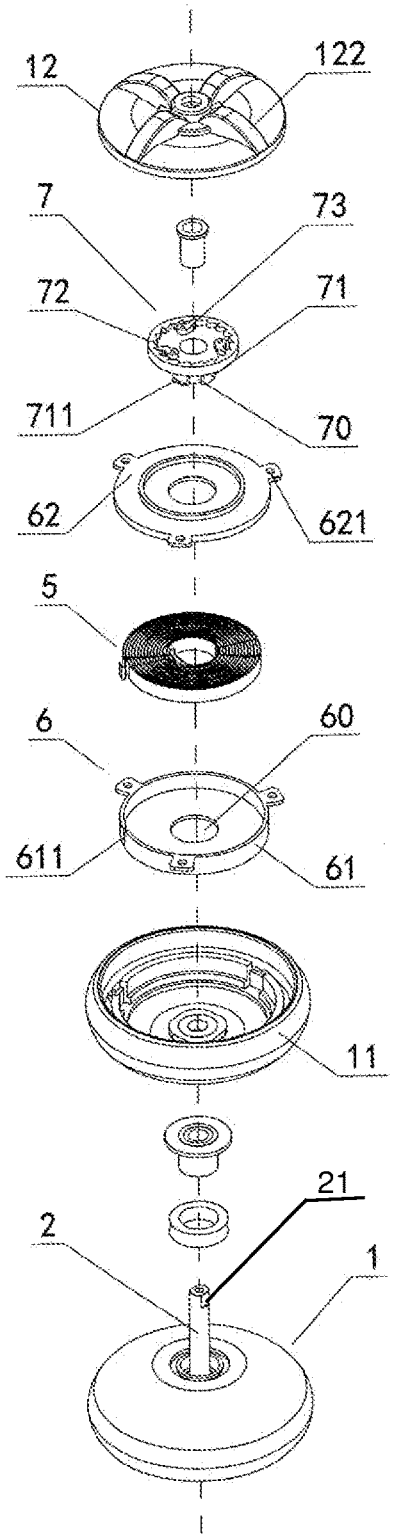
FIG. 6 is a schematic structural diagram of disassembly and assembly of the rotating body at the end where the energy storage mechanism is located according to the present invention.
Figure 7:
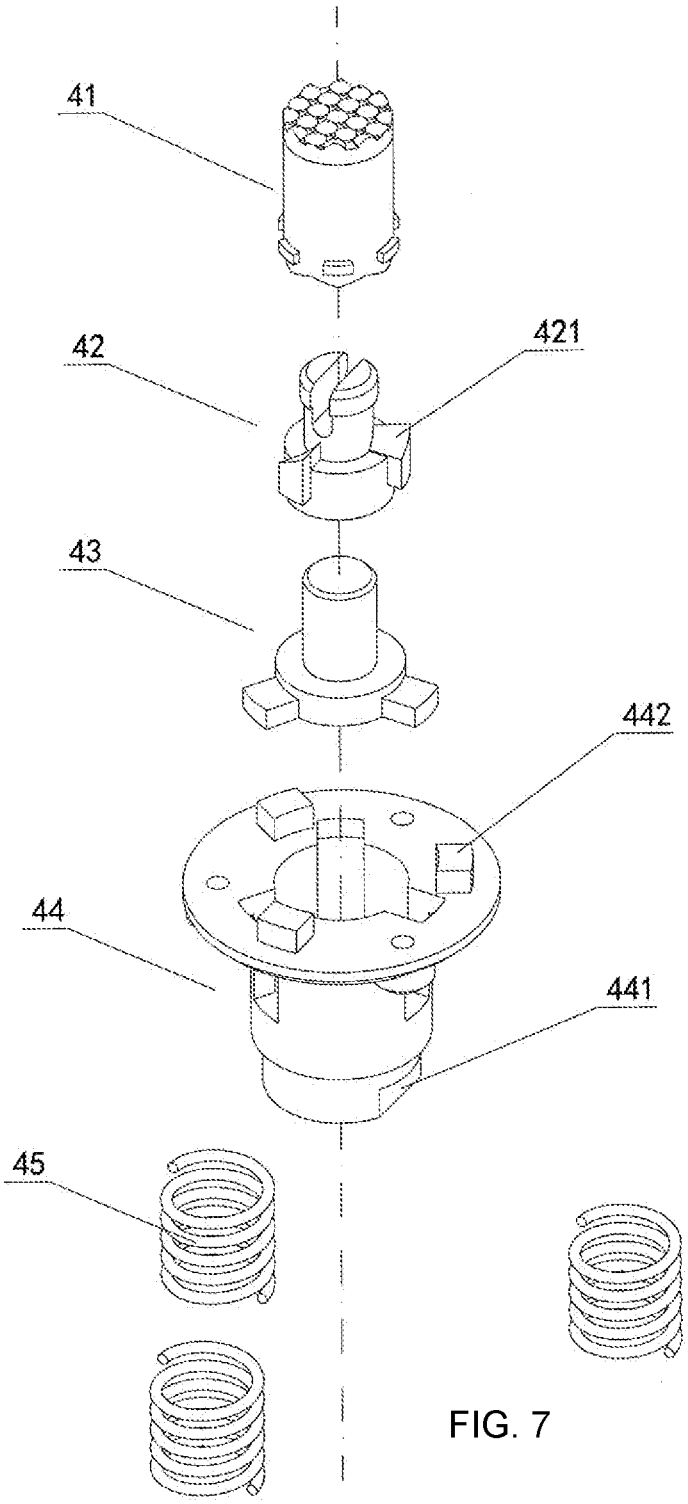
FIG. 7 is a schematic structural diagram of disassembly and assembly of the escapement member.

As shown in FIG. 6, the energy storage mechanism of this embodiment includes an energy storage spring 5, a spring case 6 and a one-way gear 7. The energy storage spring 5 is a helical spring. The inside end of the energy storage spring is fixed to the one-way gear 7 and the outside end thereof is fixed to the spring case 6. The spring case 6 includes a case body 61 and a cover body 62. A notch 611 is formed at the edge of the case body 61. An outside end of the energy storage spring 5 is fixedly connected to the notch 611. Along the periphery of the cover body 62 there is provided three lugs 621 with holes. After the cover body 62 is covered on the case body 61, they are aligned by means of holes on the lugs 621 and a screw hole on the rotating bodies 1, being connected and fixed by means of screws. A through hole 60 is formed in the middle of the spring case 6. The one-way gear 7 includes an internal gear disk 72 and a plurality of automatically rotatable limiting blocks 73 positioned in the internal gear disk 72. A gear tooth of the internal gear disk 72 is a helical gear tooth. The bottom surface of the internal gear disk 72 is downward convexly provided with a lug 70 that passes through the through hole 60 of the spring case 6 and enters into the spring case 6. Along a periphery of the lug 70 there is provided four arc-shaped pieces 71 distributed at intervals, with a gap kept between the arc-shaped piece 71 and the lug 70. At a lower end of two symmetric arc-shaped pieces 71 there is provided a hook 711. After the one-way gear 7 is inserted into the through hole 60 of the spring case 6, the hook 711 stretches out of the through hole 60 of the spring case 6 to fasten to a side the through hole. In this way it is achieved that the one-way gear 7 is relatively rotatably connected to the spring case 6. An inside end of the energy storage spring 5 is fixedly connected to the gap between the arc-shaped piece 71 and the lug 70 of the one-way gear 7. A limiting claw of the limiting block 73 in this embodiment is clamped in the helical gear tooth. Thus, when the one-way gear 7 rotates against the direction of the limiting blocks 73, the limiting claw is clamped in the helical gear tooth so that the one-way gear 7 is unable to rotate, thereby realizing a unidirectional rotation of the one-way gear 7. On the shell 12 of the rotating body 1, at the end where the energy storage mechanism is located, there is provided a mounting position 121 in which the limiting block 73 is mounted. The mounting position 121 is a pin hole and a guide plate disposed on the internal surface of the shell 12. As shown in FIG. 5, the limiting block 73 is provided with a through hole which is aligned with the pin hole and is inserted and connected by means of a lug 731. The guide plate is used for controlling the rotation direction of the limiting block 73. The middle of the shell 12 is connected to the end of the connecting shaft 2 and locked and fixed by means of screws. Therefore, the one-way gear 7 also can rotate with the connecting shaft 2 in the direction in which the one-way gear 7 rotates. When the one-way gear 7 rotates, the energy storage spring 5 is driven to tighten to store elastic potential energy. After the first clutch gear 31 is disengaged from the second clutch gear 32, the energy storage spring 5 restores and releases the elastic potential energy to drive the one-way gear 7 to rotate, while the one-way gear 7 is unable to rotate reversely at the moment, thus making two rotating bodies 1 rotate reversely, i.e., the whole yo-yo ball body rotates. The shell 12 at the end where the energy storage mechanism is located is also rotatably and fixedly connected to the connecting shaft 2. Therefore, if either side of the shell 12 is rotated, elastic potential energy can be stored in the energy storage spring 5. In this embodiment, in order to conveniently pinch the shell to rotate, on an outer side surface of the shell 12 there is provided with shanks 122 convenient for fingers to pinch to rotate.

As shown in FIG. 2 and FIG. 3, in order to ensure that the two rotating bodies 1 of the yo-yo ball body are consistent in weight to keep the balance of the center of gravity, the rotating body 1 where the clutch mechanism is located is internally provided with a weight ring 8. The weight ring 8 is placed in the disk body 11 of the rotating body 1. A ring cover 80 is covered on the weight ring 8 and is locked to the disk body 11 to fix the weight ring 8. In addition, a main bearing 9 is disposed between two rotating bodies 1 of the yo-yo ball in this embodiment, and the rope of the yo-yo ball is wrapped around the main bearing 9.

A playing method of the yo-yo ball is as below:

The yo-yo ball is wrapped around by the rope, with one hand holding the yo-yo ball body, and the other hand pressing the pressing cap 41. After the pressing cap 41 is pressed, the first clutch gear 31 and the second clutch gear 32 are in a meshing state. Then, the shell 12 on the rotating bodies 1 is rotated. The shell 12 can only rotate towards one direction and is unable to rotate reversely because it is limited by the one-way gear 7. In the process of rotation, the energy storage spring 5 starts to store elastic potential energy. Energy storage for the energy storage spring 5 is full when the shell is unable to further rotate. Then, with a finger of one hand entwined by the rope, and with the other hand pinching middle positions at two sides of the yo-yo ball body, the yo-yo ball body does not rotate to release energy even though in a state of full energy storage. Finally, the pressing cap 41 is pressed once again and then the yo-yo ball body is released. The first clutch gear 31 is disengaged from the second clutch gear 32. The energy storage spring 5 is not limited anymore and starts to restore and release elastic potential energy, which is converted into rotational energy. The yo-yo ball body starts to rotate and falls off along the rope, and finally rotates at high speed at the end of the rope. Further various fancy moves are conducted.

Although the present invention is described by reference to embodiments, the description does not signify to limit the present invention. By reference to the description of the present invention, other variations of the embodiments discloses are expectable for those skilled in the art, and these variations shall fall within the scope limited by the claims.

What is claimed is:

1. A hand-held yo-yo ball for manually storing energy, comprising: two rotating bodies and a connecting shaft having spaced apart first and second ends connecting the two rotating bodies, wherein the rotating bodies comprise a disk body and a shell, wherein the disk body of one rotating body is internally provided with a clutch mechanism having a meshing state and a non-meshing state, the disk body of the other rotating body is internally provided with an energy storage mechanism; the first and second ends of the connecting shaft are respectively connected with the clutch mechanism and the energy storage mechanism; the rotating body at the end where the clutch mechanism is located is adapted to be manually rotated relative to the other rotating body for storing energy in the energy storage mechanism when the clutch mechanism is in the meshing state; and wherein when the clutch mechanism is in the non-meshing state the energy storage mechanism releases the energy to drive the two rotating bodies to rotate synchronously;

wherein the energy storage mechanism comprises an energy storage spring, a spring case in which the energy storage spring is mounted, and a one-way gear mounted above the spring case for preventing the energy storage spring from reversely rotating to release energy when elastic potential energy is stored, wherein both the energy storage spring and the one-way gear can synchronously rotate with the connecting shaft; whereby when the rotating body with the clutch mechanism is in the meshing state and is manually rotated, the energy storage spring and the one-way gear synchronously rotate to store elastic potential energy, whereby when the clutch mechanism is in the non-meshing state the energy storage spring releases the elastic potential energy, and the one-way gear reversely rotates to drive the two rotating bodies to rotate synchronously;

wherein a through hole is formed in the middle of the spring case, the one-way gear downward convexly includes a lug that passes through the through hole and enters into the spring case, a periphery of the lug includes a plurality of arc-shaped pieces distributed at intervals, with a gap kept between the arc-shaped pieces and the lug, a lower end of the arc-shaped pieces includes a hook; whereby when the one-way gear is inserted into the through hole of the spring case, the hook stretches out of the through hole of the spring case to fasten to a side of the through hole, wherein the one-way gear is relatively rotatably connected to the spring case, and an inside end of the energy storage spring is fixedly connected to the gap between the arc-shaped piece and the lug of the one-way gear; and wherein the one-way gear comprises an internal gear disk and a plurality of automatically rotatable limiting blocks positioned in the internal gear disk, wherein a gear tooth of the internal gear disk comprises a helical gear tooth, and a limiting claw of the limiting block is clamped in the helical gear tooth, thereby realizing a unidirectional rotation of the one-way gear.

2. The hand-held yo-yo ball for manually storing energy according to claim 1, characterized in that: the clutch mechanism comprises a clutch gear set comprising a first clutch gear and a second clutch gear, and an escapement member having a first and a second state controlling the clutch gear set to engage or disengage, wherein a control end of the escapement member extends from a middle of the shell of the rotating bodies, the shell is fixedly connected with the first clutch gear of the clutch gear set, the energy storage mechanism couples with the second clutch gear of the clutch gear set by means of the connecting shaft, wherein the escapement member when in the first state after the clutch gear set is engaged, elastic potential energy is stored in the energy storage mechanism by manually rotating the shell, then wherein the escapement member when in the second state the clutch gear set is disengaged, thereby causing the energy storage mechanism to release the elastic potential energy to drive the two rotating bodies to rotate synchronously.

3. The hand-held yo-yo ball for manually storing energy according to claim 2, characterized in that: the escapement member comprises a pressing cap extending from a middle of the shell, an escapement shaft having a convex ramp surface disposed thereon, a top pressure column sleeved at a lower part of the escapement shaft, a stroke seat configured for limiting a stroke of the top pressure column, and at least one spring mounted under the second clutch gear of the clutch gear set adapted for jacking up the second clutch gear; wherein a round hole in the middle of the first clutch gear of the clutch gear set correspondingly includes a slope surface matching up with the convex ramp surface of the escapement shaft, a groove adapted for implementing engagement and disengagement of the clutch gear set, and a block surface; whereby pressing the pressing cap, the convex ramp surface of the escapement shaft is switched into the groove of the first clutch gear, whereby the second clutch gear jacks up under the action of the spring to be engaged with the first clutch gear; whereby pressing the pressing cap once again, the convex ramp surface of the escapement shaft is switched into the block surface of the first clutch gear whereby the top pressure column jacks down the second clutch gear until the second clutch gear is disengaged with the first clutch gear.

4. The hand-held yo-yo ball for manually storing energy according to claim 3, characterized in that: a lower part of the stroke seat includes an irregular hole, an end of the connecting shaft is configured as an irregular jack column connected with the irregular hole and fixed with a screw.

5. The hand-held yo-yo ball for manually storing energy according to claim 4, characterized in that: an upper surface of the stroke seat convexly includes an insertion lug, the first clutch gear correspondingly includes an insertion hole, whereby matching up the insertion lug with the insertion hole when the shell is manually rotated, the first clutch gear drives the stroke seat and the connecting shaft to rotate synchronously, and further drives, by means of the rotation of the connecting shaft, the energy storage mechanism to store elastic potential energy.

6. The hand-held yo-yo ball capable of for manually storing energy according to claim 3, characterized in that: an inward direction of the disk body convexly includes three lugs, wherein the at least one spring comprises three springs sleeved in the lugs, and the second clutch gear includes three lug holes sleeved on the lugs.

7. The hand-held yo-yo ball for manually storing energy according to claim 1, characterized in that: the spring case comprises a case body and a cover body, a notch is formed at the edge of the case body, an outside end of the energy storage spring is fixedly connected to the notch, a periphery of the cover body includes three lugs with holes; the cover body connected by screws to the case body, when aligned by holes on the lugs and a screw hole on the rotating bodies.

8. The hand-held yo-yo ball for manually storing energy according to claim 1, characterized in that: the shell of the rotating body at the end where the energy storage mechanism is located includes a mounting position in which the limiting block is mounted, the middle of the shell is connected to the end of the connecting shaft and fixed by screws, in this way, whereby when the shell is driven by the clutch mechanism to rotate in the meshing state, the energy storage spring and the one-way gear rotate synchronously to store elastic potential energy.

9. The hand-held yo-yo ball for manually storing energy according to claim 1, characterized in that: an outer side surface of the shell includes shanks for fingers to pinch to rotate the rotating body.

10. The hand-held yo-yo ball for manually storing energy according to claim 1, characterized in that: the rotating body where the clutch mechanism is located internally includes a weight ring, the weight ring is arranged in the disk body of the rotating body, a ring cover is covered on the weight ring and is locked to the disk body to fix the weight ring.

* * * * *